US008376084B2

(12) United States Patent
Castagno et al.

(10) Patent No.: US 8,376,084 B2
(45) Date of Patent: Feb. 19, 2013

(54) STRUCTURE HAVING A COMPACTABLE WALKWAY

(76) Inventors: Leo L. Castagno, Rexburg, ID (US); Richard T. Butchart, Port Ludlow, WA (US); Schyler C. Porter, Rexburg, ID (US); Bron D. Wescott, Rexburg, ID (US)

( * ) Notice: Subject to any disclaimer, the term of this patent is extended or adjusted under 35 U.S.C. 154(b) by 49 days.

(21) Appl. No.: 12/792,493

(22) Filed: Jun. 2, 2010

(65) Prior Publication Data

US 2010/0236864 A1 Sep. 23, 2010

Related U.S. Application Data

(63) Continuation of application No. 11/164,733, filed on Dec. 2, 2005, now Pat. No. 7,753,171.

(51) Int. Cl.
*E06C 5/00* (2006.01)

(52) U.S. Cl. ..... 182/84; 182/127; 280/166

(58) Field of Classification Search ..... 182/85, 182/86, 96, 159, 127; 280/166
See application file for complete search history.

(56) References Cited

U.S. PATENT DOCUMENTS

| | | | | | |
|---|---|---|---|---|---|
| 292,767 | A | | 1/1884 | Stevenson | |
| 692,191 | A | | 1/1902 | Barclay | |
| 775,366 | A | * | 11/1904 | Kratz | 105/445 |
| 830,678 | A | * | 9/1906 | Senn | 182/96 |
| 1,101,714 | A | * | 6/1914 | Rauber | 182/21 |
| 1,343,094 | A | | 6/1920 | Edward | |
| 2,393,598 | A | | 1/1946 | Boyd et al. | |
| 2,622,783 | A | * | 12/1952 | Mahoney | 182/89 |
| 2,861,731 | A | * | 11/1958 | Robinson | 182/106 |
| 2,931,456 | A | | 4/1960 | Harmon | |
| 3,547,225 | A | | 12/1970 | Deane | |
| 3,556,248 | A | * | 1/1971 | Brown et al. | 182/15 |
| 3,789,955 | A | | 2/1974 | Knapp | |
| 3,825,095 | A | | 7/1974 | Clark | |
| 3,912,298 | A | * | 10/1975 | Humphrey | 280/166 |
| 3,968,857 | A | * | 7/1976 | Bryan | 182/106 |
| 3,985,202 | A | | 10/1976 | Harmon | |
| 3,989,122 | A | | 11/1976 | Jenkins | |
| 4,155,540 | A | * | 5/1979 | Horgan, Jr. | 256/23 |
| 4,222,458 | A | | 9/1980 | Pratt | |
| 4,424,751 | A | | 1/1984 | Blochinger | |
| 4,573,239 | A | * | 3/1986 | Valenti et al. | 16/273 |
| 4,711,282 | A | | 12/1987 | Frazier et al. | |
| 4,768,617 | A | | 9/1988 | Mason et al. | |
| 4,967,733 | A | | 11/1990 | Rousseau | |
| 4,997,165 | A | * | 3/1991 | Wiese | 256/59 |
| 5,111,906 | A | | 5/1992 | Abadia | |
| 5,397,143 | A | | 3/1995 | Bird | |

(Continued)

FOREIGN PATENT DOCUMENTS

GB 2203484 A * 10/1988

*Primary Examiner* — Alvin Chin Shue
(74) *Attorney, Agent, or Firm* — Webb IP Law Group; Jason P. Webb

(57) ABSTRACT

A vehicle having a compactable walkway, including a supporting surface and a plurality of steps, pivotally coupled to the supporting surface, oriented, spaced, and positioned to provide a graduated walkway when in a deployed position and to lie substantially parallel to the supporting surface when in a retracted position. There is also a support member coupled to a distal end of each of the plurality of steps to enforce consistency of position of the plurality of steps between the deployed and retracted positions; a railing coupled to the support member; a motivator coupled to one of the plurality of steps and configured to direct the plurality of steps from the retracted position to the deployed position; a vertical support coupled to the vehicle for bracing; and a shell coupled to the railing for covering when plurality of steps are in the retracted position.

10 Claims, 4 Drawing Sheets

U.S. PATENT DOCUMENTS 5,425,615 A 6/1995 Hall et al.
5,624,127 A 4/1997 Arreola et al.
5,725,070 A 3/1998 Eldred
5,788,011 A * 8/1998 Kemmer et al. ..... 182/96
5,806,290 A 9/1998 Deutsch et al.
5,833,576 A 11/1998 Henmi
5,853,811 A * 12/1998 Poague ..... 427/421.1
5,941,342 A 8/1999 Lee
5,950,267 A 9/1999 Ricci, Jr.
5,957,237 A 9/1999 Tigner
6,068,277 A 5/2000 Magnussen
6,176,495 B1 1/2001 Decker
6,234,272 B1 5/2001 Plentl, Jr.
6,328,091 B1 * 12/2001 Whitley ..... 160/201
6,357,548 B1 3/2002 Boyd
6,810,995 B2 11/2004 Warford
7,111,858 B2 * 9/2006 Manser et al. ..... 280/163

* cited by examiner

STRUCTURE HAVING A COMPACTABLE WALKWAY

BACKGROUND OF THE INVENTION

1. Field of the Invention

The present invention relates generally to structures and vehicles having a compactable walkway and, more particularly, to folding stairs.

2. Description of the Related Art

Stairs and walkways enable access to locations and positions typically not otherwise accessible. However, use of such is typically limited to the scant moments of time it takes to achieve such access. Where access may already be achieved or may not be needed, such as when moving a structure and/or vehicle from one location to another location, stairs may serve only to be obtrusive, obstructive, unwieldy, and/or generally in the way. Accordingly, attempts have been made to provide stairs and walkways able to be compacted or otherwise reduced in size.

For example, U.S. Pat. No. 5,957,237 to Tigner discloses a collapsible step assembly that has upper and lower steps, and a housing which mounts below the door of a vehicle. The steps and housing are interconnected by pivotally mounted linkages. A pivot rod extends transversely through the housing with a linkage fastened to each end. A link arm is connected to the rod with a universal ball joint. The link arm is swivelly mounted to a drive gear with teeth which extend circumferentially along an arcuate edge portion. The drive gear is pivotally mounted to the housing and engages a drive gear extending from a motor. The drive gear rotates the pivot rod and, hence, the steps between retracted and extended positions. A flat outer edge of the drive gear abuts a mechanical stop in the extended position. When the user steps on the steps while they are extended, the stop will resist countertorque on the pivot rod from being applied through the gears to the motor. The geometry of the drivetrain causes the pivot point of the link arm to move past a central position to an overcenter position. In the overcenter position, a force on the link arm would tend to cause the drive gear to abut the stop so that the drive gear does not absorb any force.

Furthermore, U.S. Pat. No. 5,941,342 to Lee discloses a folding staircase comprises a plurality of step units each having a pair of horizontal link bars, a pair of vertical link bars that are pivotally coupled to corresponding the horizontal link bars, and a plate that are connected between the horizontal link bars, wherein the ends of the horizontal link bars are pivotally combined with those of the adjacent vertical link bars to form a step portion, and a fixing unit for fixing the step portion to a vehicle.

Still further, U.S. Pat. No. 5,111,906 to Abadia discloses a retractable ladder apparatus for access between a lower and an upper floor is provided. A ladder is moved by moving means, which may be a garage door opener, between a position of storage within the upper floor to a position where the lower end of the ladder abuts the lower floor.

However, in many cases, such devices fail to sufficiently retract, are unnecessarily complicated, include too many moving parts, are not adequately adapted for stairs along a side of a structure, and/or have a tendency to bind.

What is needed is a structure and/or vehicle including a folding stair and/or a folding stair set that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available vehicles having compactable walkways. Accordingly, the present invention has been developed to provide a structure and/or vehicle having a compactable walkway.

According to one embodiment of the present invention, there is a structure and/or vehicle having a compactable walkway up and along a side of the vehicle. The vehicle includes a supporting surface extending from a lower portion of the vehicle to a higher portion of the vehicle; and a plurality of steps, pivotally coupled to the supporting surface, oriented, spaced, and positioned to provide a walkway, that may be graduating such as with stairs, when in a deployed position and to lie substantially parallel to the supporting surface when in a retracted position. There may further be included a support member coupled to a distal end of each of the plurality of steps, wherein the support member may enforce consistency of position of the plurality of steps between the deployed and retracted positions. There may also be a railing coupled to the support member and configured to provide a balancing support for a user climbing the plurality of steps when the plurality of steps are in the deployed position. The plurality of steps may further comprise rectangular plates horizontally spaced such that there is no vertical overlap between adjacent steps. There may also be a motivator coupled to one of the plurality of steps and configured to direct the plurality of steps from the retracted position to the deployed position. There may also be a vertical support coupled to the vehicle and configured to brace the plurality of steps in the deployed position. The vertical support may further comprise a triangular member rotatably coupled to the vehicle at a first edge and configured to be rotated under one of the plurality of steps and interface with the one of the plurality of steps at a second edge. There may also be included a shell that may be coupled to the railing and may extend over the railing, the first support, the support member, and the plurality of steps when the plurality of steps are in the retracted position.

In another embodiment, there is a folding stair for providing a compactable walkway up and alongside a structure. The folding stair may include a supporting surface extending from a lower portion of the structure to a higher portion of the structure; a plurality of steps rotatably coupled to the supporting surface, each spaced to provide a graduated walkway when in a deployed position and to lie substantially parallel to the supporting surface when in a retracted position; a support member pivotally coupled to each of the plurality of steps; and/or a motivator coupled to the plurality of steps and configured to motivate a transition between the deployed and retracted positions. The support member may be pivotally coupled to the plurality of steps.

In yet another embodiment, there is folding stair for providing a compactable walkway. The folding stair may include a first support member; a second support member; a first step disposed between the first and second support members and pivotally coupled to each of the first and second support members about a first and a second axis of rotation, each axis of rotation substantially parallel to horizontal axis of the first and second support members, respectively; and/or wherein, in a deployed position, the first step extends substantially horizontally and, in a retracted position, the first step extend substantially vertically from the first support member to the second support member. There may also be a railing coupled to the second support member. The first support member may include a coupling member configured to couple to a structure. There may also be a shell coupled to the railing. There may also be a motivator coupled to one of the components from the group of components including the step and the support member, wherein the motivator is configured to transition the step in at least one direction between the deployed and retracted positions. There may also be a hinge coupled between the step and the first support and extending therefrom, wherein the hinge comprises: first and second apertured flanges coupled to the step and the first support, respectively; a tubular member through each of the first and second apertured flanges; and/or a substantially flexible annular member disposed between the first and second flanges and substantially encircling the tubular member. The first and second axis of rotation may, in one embodiment, not be substantially parallel to a longitudinal axis of the second support member. There may also be a second step, disposed between the first and second support members and higher than the first step, rotatably coupled to each of the first support and the support member about third and fourth axis of rotation each axis of rotation substantially parallel to the first and second axis of rotation of the first step, wherein in a deployed position the second step extends substantially horizontally and in a retracted position the second step extend substantially vertically from the first support to the support member. The shell may be sized and disposed to substantially cover the railing, the first and second support members, and the step when the step is in the retracted position. The shell may include an arcuate cross-section.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
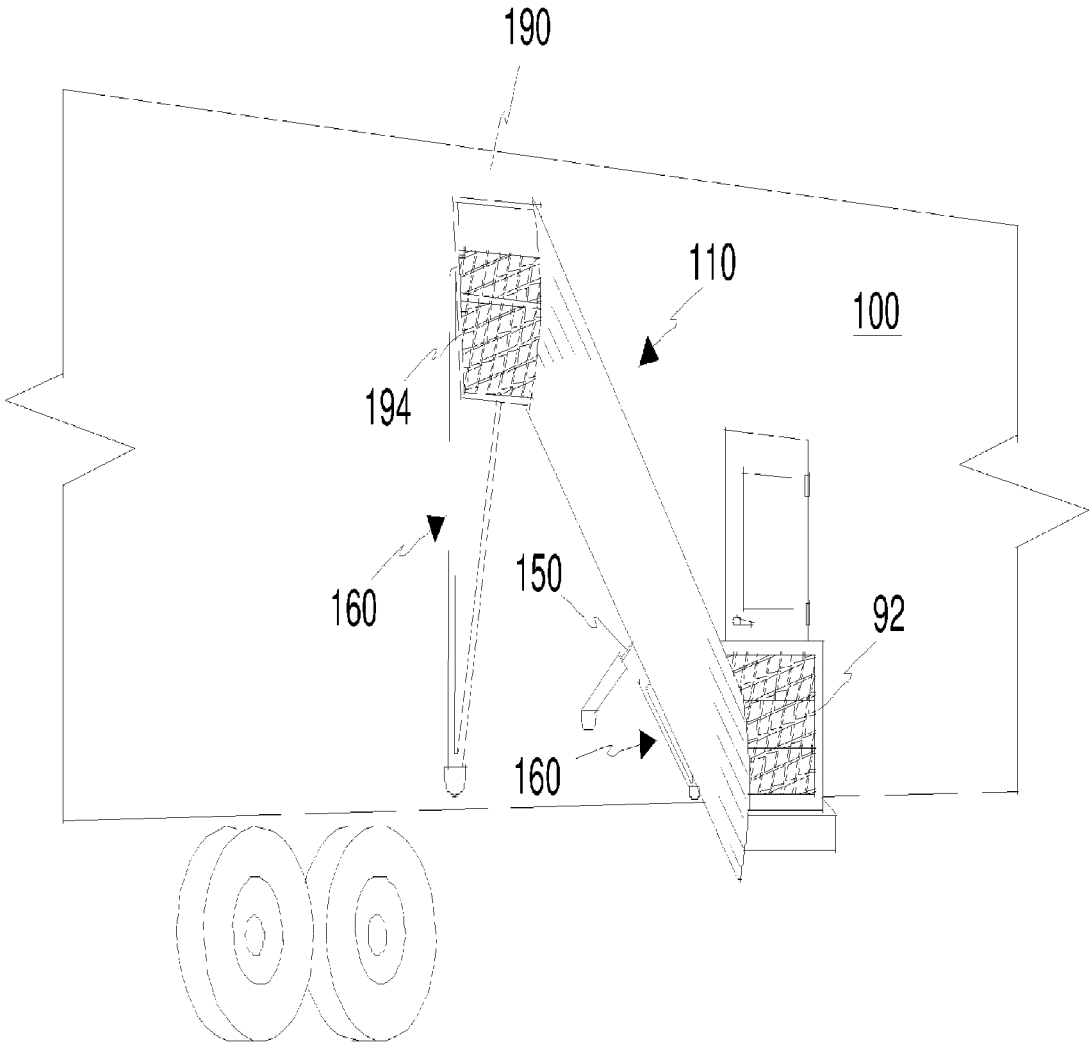
FIG. 1 illustrates a perspective side view of a vehicle having a compactable walkway in a retracted position according to one embodiment of the invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments are considered to be able to be combined in whole or in part one with another as the claims and/or art may direct, either directly or indirectly, implicitly or explicitly.

Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

Looking to the figures, there is shown a vehicle 100 having a compactable walkway up and along a side of the vehicle 100. In the illustrated embodiment, the vehicle 100 is a trailer for a rig. It is envisioned that a great variety of vehicles may benefit from the present invention, including but not limited to RVs, camp trailers, and trucks. The illustrated vehicle 100 includes a supporting surface 102 extending from a lower portion 97 of the vehicle 100 to a higher portion 99 of the vehicle 100. While a supporting surface 102 may be a surface of the vehicle 100 such as but not limited to a side-wall of the vehicle 100, in many instances such surfaces innate to the vehicle may lack sufficient strength to support a folding stair in use. Accordingly, in the illustrated embodiment, the supporting surface 102 is coupled to the side-wall of the vehicle and includes a metal tube whereupon steps 104 may be coupled.

Figure 2:
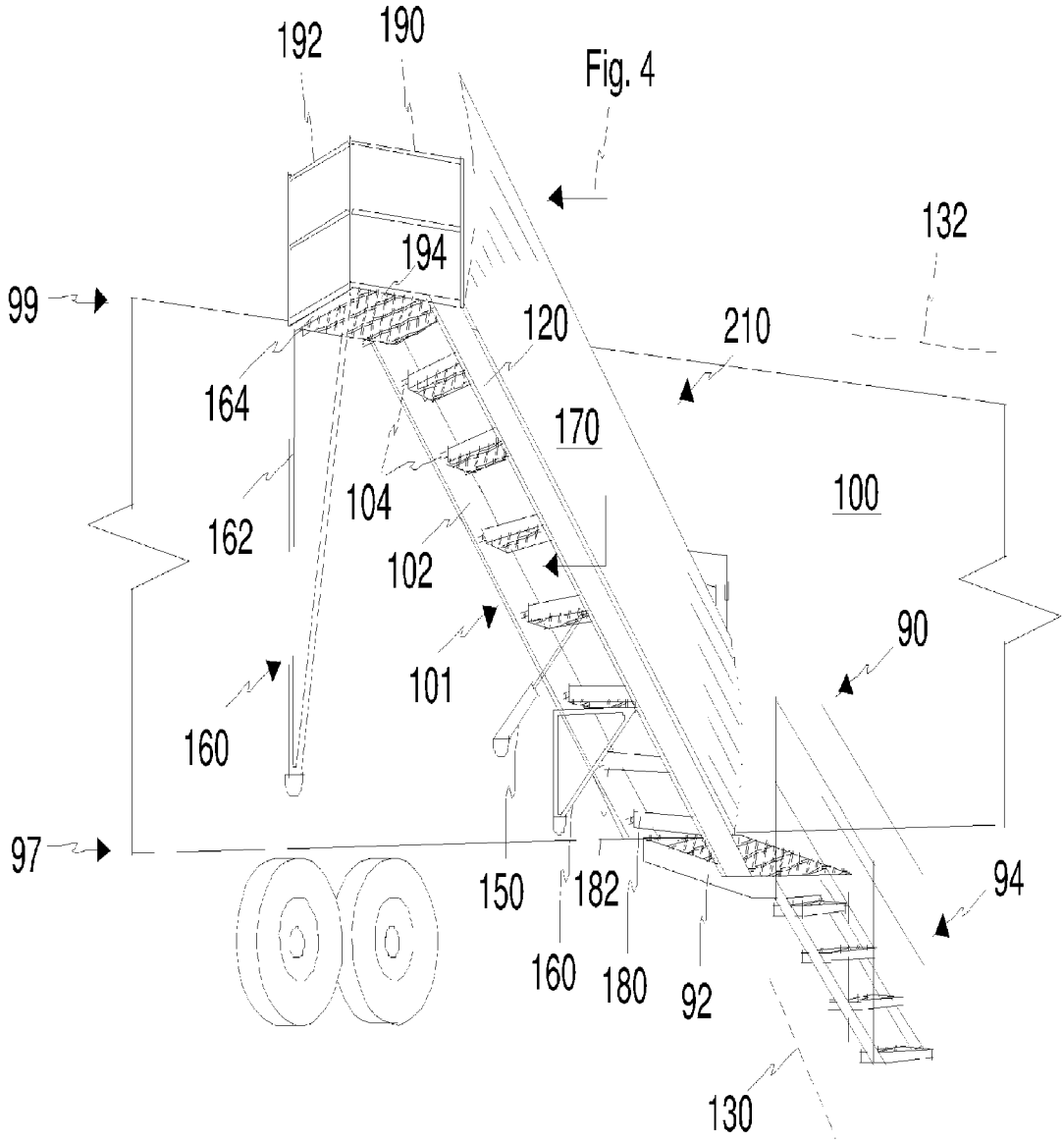
FIG. 2 illustrates a perspective side view of a vehicle having a compactable walkway in a deployed position according to one embodiment of the invention.

The illustrated embodiment also shows a plurality of steps 104, pivotally coupled to the supporting surface 102, oriented, spaced, and positioned to provide a walkway. While a great variety of walkways are envisioned, the illustrated embodiment shows a walkway that is a set of stairs configured to enable a user to walk up the side of the vehicle 100. Accordingly, the individual stairs or steps 104 are graduated, that is each is higher and further than the last, thereby providing a graduated walkway when the steps 104 are in a deployed position 210 as shown in FIG. 2. When the steps 104 are in a retracted position 110, as shown in FIG. 1, the steps 104 lie substantially parallel to the supporting surface 102. The illustrated plurality of steps 104 are rectangular plates having a textured surface for decreasing chance of a user slipping during use. The steps 104 are also horizontally spaced such that there is no vertical overlap between adjacent steps 104. Accordingly, the illustrated steps 104 do not overlap when in the retracted position 110, thereby minimizing the profile of the folding stairs when in the retracted position 110.

There is also shown a support member 120 coupled to a distal end 310 of each of the plurality of steps 104, wherein the support member 120 may enforce consistency of position of the plurality of steps 104 between the deployed 210 and retracted 110 positions. The illustrated support member 120 is a metal tube having a rectangular cross-section. The support member 120 is disposed at an angle following diagonal array of steps 104. Accordingly, the longitudinal axis 130 of the support member extends along that diagonal array. Also, the horizontal axis 132 of the support member 120 extends parallel to the horizontal spacing of the steps 104 and the planarity of the steps 104. The steps 104 of the illustrated embodiment are coupled to the support member 120 and to the support surface in paired hinges 320. Also, the paired hinges 320 couple to the support member 120 at substantially identical vertical locations, but substantially different locations along the side of the support member 120. Accordingly, as the steps 104 are transitioned to and from the deployed 210 and retracted 110 positions, the illustrated support member 120 retains its substantially vertical orientation, as to do otherwise would require detachment from the steps 104, wherein the illustrated steps 104 are substantially planarly parallel but not substantially coplanar.

This feature is beneficial wherein there is a railing 140 coupled to the support member 120 and configured to provide a balancing support for a user climbing the plurality of steps 104 when the plurality of steps 104 are in the deployed position 210. Wherein the support member 120 retains a vertical orientation while the steps 104 pivot, so does the railing 140. Accordingly, a railing 140, as in the shown embodiment, that is oriented vertically for use in the deployed position 210, also remains oriented vertically in the retracted position 110, which orientation enables the folding stair 101 to include a railing 140 of sufficient height to be useful and still keep a minimized profile when in the retracted position 110.

There is also shown a motivator 150 coupled to one of the plurality of steps 104 and configured to direct the plurality of steps 104 from the retracted position 110 to the deployed position 210. The illustrated motivator 150 is a hydraulic cylinder pivotally coupled to a side of the vehicle 100 such that when the cylinder is retracted, the plurality of steps 104 are in the retracted position 110 and the cylinder 150 is at a slight angle relative to the surface of the vehicle 100, thereby permitting sufficient leverage such that when the cylinder 150 is extended, the plurality of steps 104 are lifted towards the deployed position 210. It is estimated that angles relative to the surface of the vehicle as low as 3-5 degrees may be sufficient, but angles over 5 degrees may be better. In one embodiment, such an angle is achieved by insetting a base of the motivator 150 beyond the plane of the support surface 102, as may be achieved by having a support surface 102 extend a distance from a wall of a structure and/or recessing the base of the motivator 150 into the structure. In another embodiment, such an angle is achieved by not fully folding the stairs 101, such that the stairs 101 are not exactly orthogonal to ground, but substantially so.

In one embodiment, the cylinder 150 may be controlled by a two control system, wherein one control pumps fluid, thereby actuating the cylinder 150 and the other control determines a direction of flow, thereby determining whether the cylinder 150 extends or retracts. Further, actuation of a single control may do nothing, thereby enhancing safety by preventing accidental actuation of the cylinder such as by road detritus being caught against a single control and thereby deploying the folding stairs 101 while a vehicle 100 is in motion. In other embodiments, a motivator may be a spring, a winch, a screw, scissor-mechanism, and/or an air, electricity, and/or magnet powered motivator.

In the illustrated embodiment, there is shown a vertical support 160 pivotally coupled to the vehicle 100 and configured to brace the plurality of steps 104 in the deployed position 210 when the vertical support is pivoted from a stowed position to a supporting position. The illustrated vertical support 160 further comprises a triangular member 160 rotatably coupled to the vehicle 100 along a first edge 162 and configured to be rotated under one of the plurality of steps 104 and interface with the one of the plurality of steps 104 at a second edge 164 of the triangle. Accordingly, in use, a user may extend a motivator 150 to transition a plurality of stairs 104 to slightly beyond a deployed position, then pivot a vertical support 160 under a portion of the plurality of stairs 104, then allow the plurality of stairs to be in the deployed position 210 whereat they may rest upon the vertical support 160. Other embodiments include vertical supports that may not be pivotally coupled to the vehicle but are still configured to support. For example, a vertical support may be slidably, rotatably, fixedly, ratchetingly, and/or otherwise coupled to the vehicle and/or another surface or base including but not limited to the ground, whereby the vertical support may support the stairs.

Further displayed in the illustrated embodiment is a shell 170, coupled to the railing 140. Further, in the illustrated embodiment, the shell 170 extends substantially over the railing 140, the first support member 102, the support member 120, and the plurality of steps 104 when the plurality of steps 104 are in the retracted position 110. A potential use/advantage of such may include restricting access to portions of the folding stairs 101 when in a retracted position 110. In another embodiment, a shell 170 may enhance fuel economy of a vehicle 100 traveling with a folding stair 101. In yet another embodiment, a shell 170 may be configured to disguise the folding stair 101 as a portion of a side of a vehicle 100. It is envisioned that a shell 170 may be a light-weight polymer and/or fiber material configured to block a user of the folding stairs 101 from the elements, such as but not limited to wind and sun.

In another embodiment, there is a folding stair 101 for providing a compactable walkway up and alongside a structure 100. The folding stair 101 includes a supporting surface 102 extending from a lower portion 97 of the structure 100 to a higher portion 99 of the structure 100; a plurality of steps 104 rotatably coupled to the supporting surface 102, each spaced to provide a graduated walkway when in a deployed position 210 and to lie substantially parallel to the supporting surface 102 when in a retracted position 110; a support member 120 pivotally coupled to each of the plurality of steps 104; and a motivator 150 coupled to the plurality of steps 104 and configured to motivate a transition between the deployed 210 and retracted 110 positions. The support member 120 is pivotally coupled to the plurality of steps 104. The illustrated structure 100 is a vehicle 100, as previously described. It is envisioned that the structures that may be related to, coupled to, and/or included in the present invention are plethoric. Embodiments include, but are not limited to: vehicles, fluid tanks, residences, apartment complexes, warehouses, control towers, and industrial facilities. It is envisioned that such may be useful in many situations, including but not limited to wherein a user may need a walkway or stair up and/or along a side of a structure, wherein the walkway and/or stair may be inconvenient at some time, such as but not limited to during movement of the structure and/or other nearby objects.

In yet another embodiment, there is folding stair 101 for providing a compactable walkway. The folding stair 101 may be coupled to a structure 100, such as but not limited to a vehicle 100, and may be used for the purpose of climbing on an exterior of the vehicle 100 to a top of the vehicle 100. The folding stair 101 includes a first support member 102 and a second support member 120. There is also included a first step 180 disposed between the first and second support members 102 and 120 and pivotally coupled to each of the first and second support members 102 and 120 about a first and a second axis of rotation 134 and 136, each axis of rotation 134 and 136 substantially parallel to horizontal axis 132 of the first and second support members 102 and 120, respectively. Further, in a deployed position 210, the first step 180 extends substantially horizontally. Still further, in a retracted position 110, the first step extend substantially vertically from the first support member 102 to the second support member 120.

Figure 3:
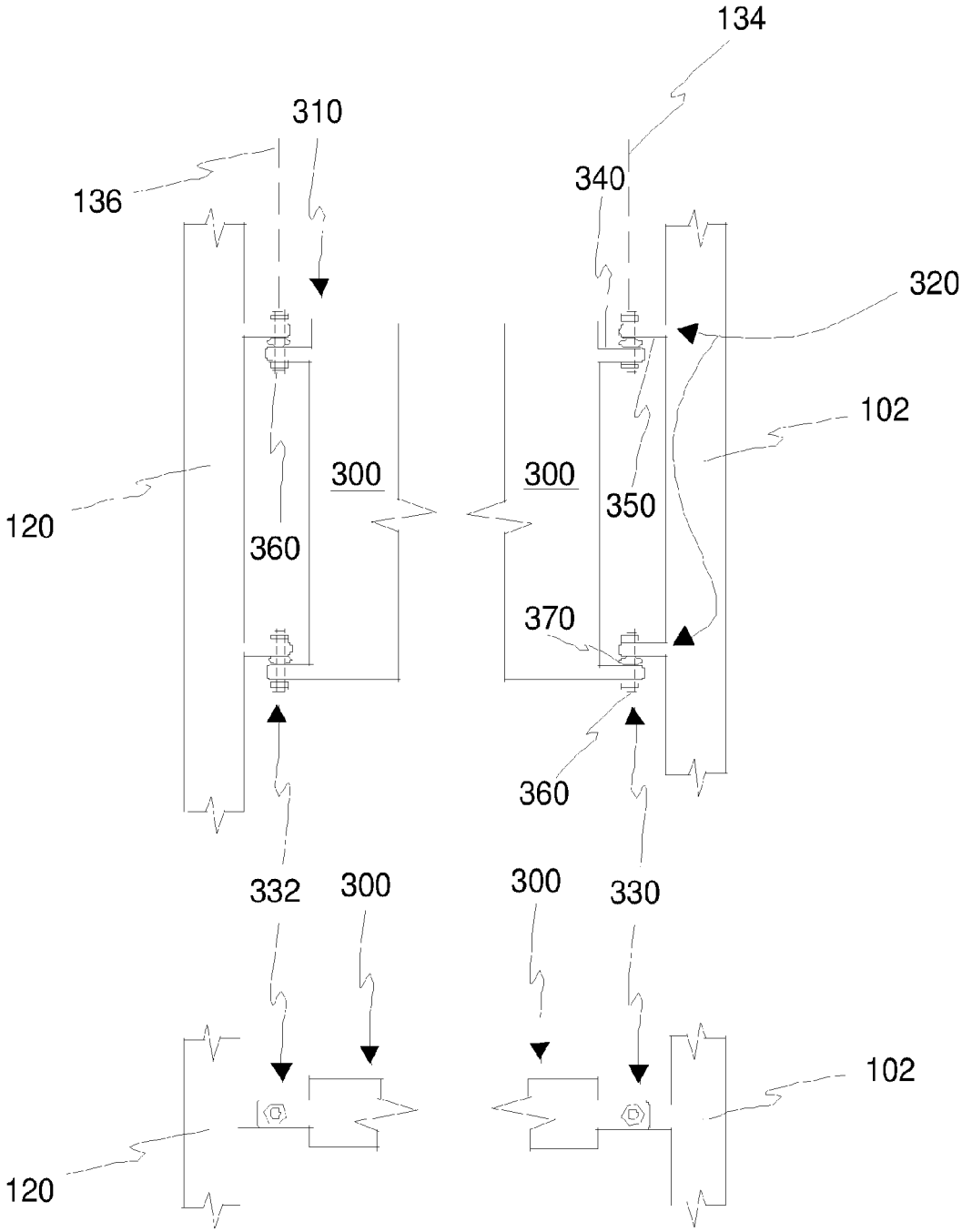
FIG. 3 illustrates top and front plan views of a folding stair according to one embodiment of the invention.
Figure 4:
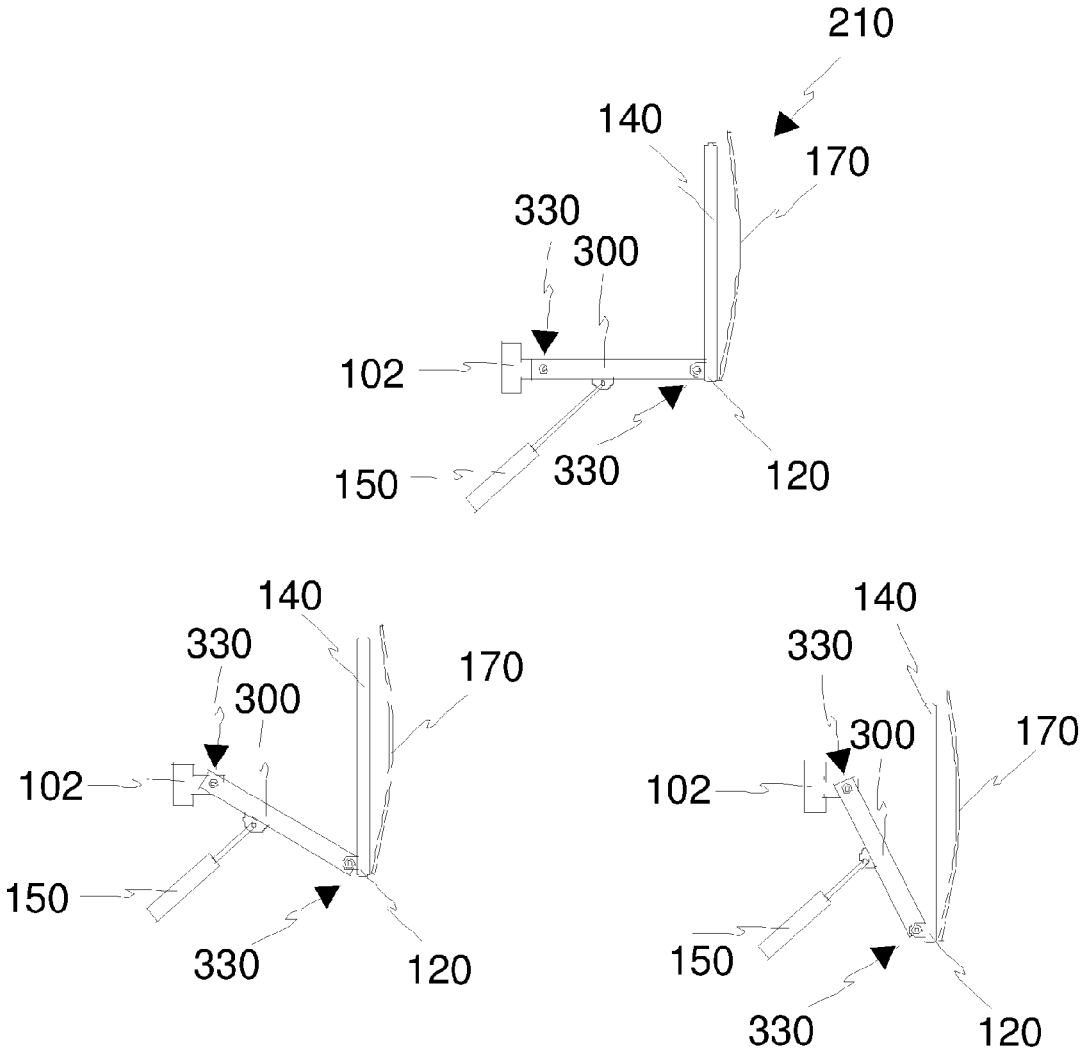
FIG. 4 illustrates front plan views of a folding stair transitioning from a deployed position to a retracted position.

As shown in FIG. 3, in one embodiment, there is a hinge 330 coupled between the step 300 and the first support member 102 and extending therefrom. The illustrated hinge 330 includes: first and second apertured flanges 340 and 350 coupled to the step 300 and the first support member 102, respectively; a tubular member 360 through each of the first and second apertured flanges 340 and 350; and a substantially flexible annular member 370 disposed between the first and second flanges 340 and 350 and substantially encircling the tubular member 360. Similarly, there are hinges 332 coupling the step to the second support member 120.

In the illustrated embodiment, the first and second axis 134 and 136 of rotation, are each not substantially parallel to a longitudinal axis 130 of the second support member 120. There is also a second step 182, disposed between the first and second support members 102 and 120 and higher than the first step 180, rotatably coupled to each of the first and second support members about third and fourth axis of rotation (see 134 and 136) each axis of rotation substantially parallel to the first and second axis of rotation 134 and 136 of the first step 180, wherein in a deployed position 210 the second step 182 extends substantially horizontally and in a retracted position 110 the second step 182 extends substantially vertically from the first support member 102 to the support member 120. Accordingly, the first step 180 and the second step 182 may pivot simultaneously without significant binding and/or negative feedback, wherein the steps are joined together by the first support member 102 and the second support member 120. The substantially flexible annular member 370 further facilitates simultaneous pivoting, wherein small variations in axis of rotation and/or other dimensions of importance may be absorbed by flexing during transition between positions.

The folding stair 101 may retract into a recessed portion of a vehicle 100 and/or structure 100 and may do so such that the shell 170 may be flush with the non-recessed portion of the vehicle 100 and/or structure 100, thereby presenting a cross-sectional profile substantially consistent with that of the vehicle 100 and/or structure 100.

Further, in the illustrated embodiment, the folding stair 101 includes a top landing 194 having a first landing railing 190 and a second landing railing 192. The first landing railing 190 is contiguous to the railing 140. The second landing railing 192 is pivotally coupled to the first landing railing 190 and may be pivoted to be adjacent to and parallel to the first landing railing 190 when preparing the folding stairs 101 for retraction. Further, the landing step 300 is similar to the plurality of steps in connection to other portions of the folding stairs 101, but typically is larger.

Yet still further, there is shown a bottom stair portion 90 including a bottom landing 92 and a bottom stair 94. The bottom landing 92 is pivotally coupled to the vehicle 100 and/or structure 100 such that it may be lifted to lay against the side of the vehicle 100 and/or structure 100 and may be held in place by a pin. The bottom stair may be a motorized or non-motorized retracting and/or "disappearing" stair similar to those stairs disclosed in U.S. Pat. Nos. 3,789,995 to Knapp and 3,985,202 to Harmon, which patents are incorporated by reference herein in their entirety.

In one embodiment, the folding stair 101 is coupled to a trailer configured to be pulled by rig. The trailer may further include a lifting command center accessible on the roof of the trailer. In use, a user may travel with the trailer to a site, deploy the command center and the folding stairs and then use the folding stairs to enable access to the command center without requiring another means of accessing the command center and/or the roof of the trailer.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

It is expected that there could be numerous variations of the design of this invention. An embodiment is that the steps could be shaped other than rectangular plates, such as but not limited to oval, square, and rod-like. Another embodiment is that steps may be a continuous plane making an inclined plane from bottom to top, such as for a handicap access walkway.

Finally, it is envisioned that the components of the device may be constructed of a variety of materials, including but not limited to metal, wood, ceramic, plastic, resin, composites, and fibers.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A folding stair for providing a compactable walkway up and alongside a structure, comprising:

a supporting surface parallel to a surface of a structure, fixed in orientation thereto such that the supporting surface does not move and extending from a lower portion of the structure to a higher portion of the structure, and rigidly coupled to the surface of the structure at both the lower portion of the structure and the higher portion of the structure; wherein the lower portion of the structure includes a bottom landing pivotally coupled to the structure having a bottom stair extending orthogonally therefrom; wherein the higher portion of the structure includes a top landing pivotally coupled thereto;

a plurality of steps, each rotatably coupled directly to the supporting surface, at an end thereof such that the plurality of steps are rotatable about the supporting surface, each spaced to provide a graduated walkway when in a deployed position and to lie substantially parallel to the supporting surface when in a retracted position, wherein the plurality of steps rotate about a long axis of the supporting surface;

a support member coupled to each of the plurality of steps at an opposite end of the steps where the plurality of steps are coupled to the supporting surface and wherein the support member is not directly coupled to the surface of the structure; and a motivator coupled to the plurality of steps and configured to motivate a transition between the deployed and retracted positions, wherein the top landing comprises a platform larger than each of said steps and pivotally coupled to said support member, further comprising a railing coupled to the support member, and the top landing having a first landing railing contiguous to the railing and a second landing railing pivotally coupled to the first landing railing.

2. The folding stair of claim 1, wherein the support member is pivotally coupled to the plurality of steps.

3. A folding stair for providing a compactable walkway, comprising:

a first support member; wherein the first support member includes a bottom landing pivotally coupled to the first support member and having a bottom stair extending orthogonally therefrom;

a second support member; wherein the second support member includes a top landing pivotally coupled thereto;

an elongated first step disposed between the first and second support members and pivotally coupled to each of the first and second support members about opposite short ends of the step and about a first and a second axis of rotation, each axis of rotation substantially parallel to a horizontal axis of the first and second support members, respectively;

an elongated second step disposed between the first and second support members and spaced higher than the elongated first step and laterally therefrom thereby forming a graduated walkway going up and alongside the first support member, wherein the elongated second step is pivotally coupled to each of the first and second support members about opposite short ends of the step and about a first and second axis of rotation, each axis of rotation substantially parallel to the horizontal axis of the first and second support members, respectively; and wherein, in a deployed position, each of the first step second step extends substantially horizontally from the first support member to the second support member and, in a retracted position, extend substantially parallel along elongated sides of the steps from the first support member to the second support member, and wherein the first and second elongated steps are pivotally coupled to the first support member such that they rotate about a long axis of the first support member, thereby folding upwards alongside the first support member while lifting the second support member higher than the first support member, wherein the top landing comprises a platform larger than each of said steps, further comprising a railing coupled to the second support member, and the top landing having a first landing railing contiguous to the railing and a second landing railing pivotally coupled to the first landing railing.

4. The folding stair of claim 3, wherein the first support member comprises a coupling member configured to couple to a structure.

5. The folding stair of claim 1, further comprising a shell coupled to the railing.

6. The folding stair of claim 3, further comprising a motivator coupled to a component selected from a group of components consisting of the step and the support member, wherein the motivator is configured to transition the step in at least one direction between the deployed and retracted positions.

7. The folding stair of claim 3, further comprising a hinge coupled between the step and the first support member and extending therefrom, wherein the hinge comprises:

a first and second apertured flanges coupled to the step and the first support, respectively;

a tubular member through each of the first and second apertured flanges; and a substantially flexible annular member disposed between the first and second flanges and substantially encircling the tubular member.

8. The folding stair of claim 3, wherein the first and second axis of rotation are not substantially parallel to a longitudinal axis of the second support member.

9. The folding stair of claim 5, wherein the shell is sized and disposed to substantially cover the railing, the first and second support members, and the step when the step is in the retracted position.

10. The folding stair of claim 9, wherein the shell includes an arcuate cross-section.

* * * * *